United States Patent [19]

Deal

[11] 4,191,445

[45] Mar. 4, 1980

[54] LOUVERED ELECTRICAL CONNECTOR

[75] Inventor: Robert S. Deal, Los Altos Hills, Calif.

[73] Assignee: Multilam Corporation, Los Altos, Calif.

[21] Appl. No.: 649,893

[22] Filed: Jan. 16, 1976

[51] Int. Cl.[2] ..... H01R 13/12

[52] U.S. Cl. ..... 339/252 R; 339/278 C

[58] Field of Search ..... 339/95, 252, 255, 256, 339/278

[56] References Cited

U.S. PATENT DOCUMENTS

| | | | |
|---|---|---|---|
| 2,486,285 | 10/1949 | Hurst | 339/278 C |
| 3,638,166 | 1/1972 | Steipe | 339/278 C |
| 3,895,853 | 7/1975 | Neidecker | 339/252 R |

FOREIGN PATENT DOCUMENTS

| | | | |
|---|---|---|---|
| 2138989 | 1/1973 | Fed. Rep. of Germany | 339/255 R |

*Primary Examiner*—Joseph H. McGlynn

*Attorney, Agent, or Firm*—Townsend and Townsend

[57] ABSTRACT

An improved electrical connector formed from a louvered device provided with a layer of electrical conducting material on the louvered portion of the device. The clad layer forms a bridge between a pair of electrical current-carrying members when the louvered device is disposed between the members and when the clad material is in electrical contact therewith. The louvered device can be used individually or in an assembly of a group of such devices. The assembly can be in a form suitable to allow the assembly to fit between a pair of flat electrically conducting plates. Other forms of the assembly include a cylindrical configuration wherein the devices are arranged about the inner periphery of an electrically conducting sleeve and arranged to contact a plug inserted into one end of the sleeve. Other forms of assembling the individual louvered devices can be used to fit specific design requirements.

2 Claims, 16 Drawing Figures

LOUVERED ELECTRICAL CONNECTOR

This invention relates to improvements in electrical connectors of the louvered type and, more particularly, to an electrical connector having improved current-carrying means on the louvers thereof.

BACKGROUND OF THE INVENTION

In U.S. Pat. No. 3,161,451, an electrical connector is disclosed wherein a plurality of louvers of electrically conducting material are integral at their ends with elongated strips with the strips being flexible so that the array of louvers can be arranged in a cylindrical configuration to form an electrical connector of tubular design. While this arrangement is satisfactory in certain connector applications, it has limitations inasmuch as it requires trade-offs between structural characteristics and electrically conducting characteristics. Thus, while one material may be a good electrical conductor, it may not have the proper structural characteristics, including resilience, of another, more desirable material. Limitations such as this provide relatively little latitude in selecting materials for forming louvered connectors of the type described in the above patent. In addition, the limitation of metals inherently create electrical conductance limitations. If better conductive materials could be employed, a vastly greater scope of design could be achieved. A need, therefore, has arisen to provide a more suitable electrical connector, one providing greater latitude in selecting materials for use in various applications of different structural and electrical requirements.

SUMMARY OF THE INVENTION

The present invention overcomes the limitations of electrical connectors of the type described by providing an electrical connector formed of one or more louvers, with each louver having a layer of electrical conductive material thereon. In this way, the louver can be of one material and the electrical conducting portion can be of a second material thereby allowing greater selectivity of material characteristics and thereby greater latitude in meeting structural, electrically conducting and other requirements of specific applications for electrical connectors.

The invention can allow for electrical conductors of various sizes, configurations and current-carrying capacities. Thus, the invention can be made in the form of an assembly of louvered devices arranged in side-by-side relationship to fit between and to form an electrical path between a pair of flat buss bars or plates. In the alternative, the assembly of louver devices can be cylindrical in shape to fit along the inner surface of an electrically conducting sleeve adaptable for receiving a jack or plug. The louver devices can be integral with side strips or individual louver devices can be mounted one-by-one in end bars or strips. The louver devices can be of electrically conductive material or non-conductive material, the only requirement being that the clad layer on each louver device is electrically conducting to form the current-carrying path across the transverse dimension of the louver of the device.

The primary object of this invention is to provide an improved electrical connector of the louver type wherein each louver has a layer of electrically conducting material clad thereon in any suitable manner so that the resulting product can have optimum structural and electrically conductive characteristics notwithstanding the fact that the material of the louver and the clad material differ from each other. Because of better conductivity, larger and wider louvers can be used which, in turn, create a much broader design range and important economies in connector design.

Another object of this invention is to provide an electrical connector of the type described wherein the connector can be formed from one or more louvered devices and the louver portion thereof can be either electrically non-conducting or conducting depending upon the design requirements to be met, yet the resulting product will have excellent current-carrying capabilities and adaptability to various electrical members to be interconnected.

Other objects of this invention will become apparent as the following specification progresses, reference being had to the accompanying drawings for several embodiments of the invention.

In the drawings:

FIG. 1 is a louvered device which is clad with an electrical conducting means at the central portion thereof;

FIG. 1*a* is a fragmentary view similar to FIG. 1, but showing the edge portion in the form of fingers;

FIG. 1*b* is a cross-sectional view taken along line 1*b*—1*b* of FIG. 1;

FIG. 1*c* is a view similar to FIG. 1*b* but showing another embodiment of the louver;

Figure 1:
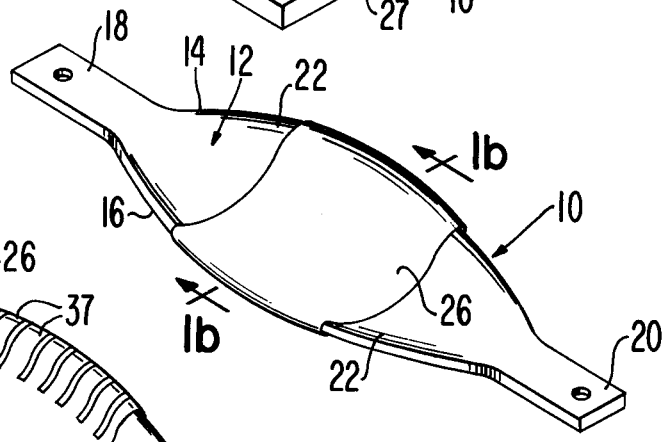
Figure 1:
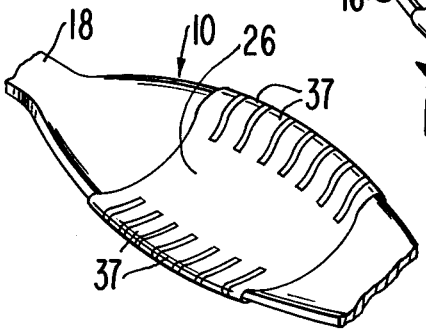
Figure 1:
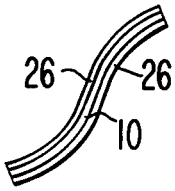
Figure 1:
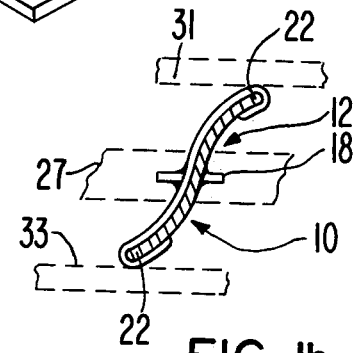

The present invention, in its basic form, comprises a louver device 10 (FIG. 1), having a louver 12 provided with arcuate, curved side edges 14 and 16 and integral with end extensions 18 and 20 which are generally coplanar with each other. The plane of louver 12 is angled with respect to extensions 18 and 20 as shown in FIG. 1*b* and the louver has curved outer margins 22 which are out of the plane of the major portion 24 thereof. The material of louver device 10 can be of metal, plastic or the like and the material is preferably of the type providing a mechanical springing action which allows the louver 12 to yield about an axis through extensions 18 and 20 when force is applied to outer margins 22 thereof, such as when the louver is between a pair of connector members as hereinafter described.

Louver 12 is clad with a layer 26 of electrically conducting material and this layer can be applied in the form of an overlapping or wrap-around strip, an inlay strip, or as a plated surface or as a sputtered or other type of surface. The material of layer 26 may extend from one outer margin 22 to the opposite outer margin 22 of louver 12 so that, when the louver is between a pair of electrically conducting members, the clad layer 26 will form an electrically conducting bridge between the members. Thus, louver device 10 need not be electrically conductive and may be of plastic or other electrically non-conductive material or a metal of relatively low conductivity but high strength. The only conducting path will, of course, be through layer 26 and it generally will be adequate for most purposes without the need to make louver device 10 from an electrically conducting material. It is also possible to apply conductive layers 26 to both sides of louver 12 where the latter is of a metallic material in the same manner to create the same effect as in the form of an overlay wrap-around layer 26.

FIG. 1*c* shows how layers 26 can be disposed on opposite sides of the louver without the layers being in electrical contact. However, the two layers are so close to each other at the outer curved side edges of the louver that there will be proper electrical conduction therebetween.

The foregoing construction also allows for the use of the best material for the mechanical spring action of louver device 10 where mechanical properties of one material may be desirable over another or where the weight and conductivity of the material and the method of manufacturing the same are important design considerations. Also, in combination with the most desirable material for louver device 10, the clad layer can also be selected for desired properties and economies. Moreover, the clad material can be of sufficient thinness to allow for it to be clad in an arcuate curve along louver 12 and about the side margins 22 thereof as shown in FIG. 1*b*. This assures proper electrical contact at all times with conducting members utilized with the device.

Figure 12:
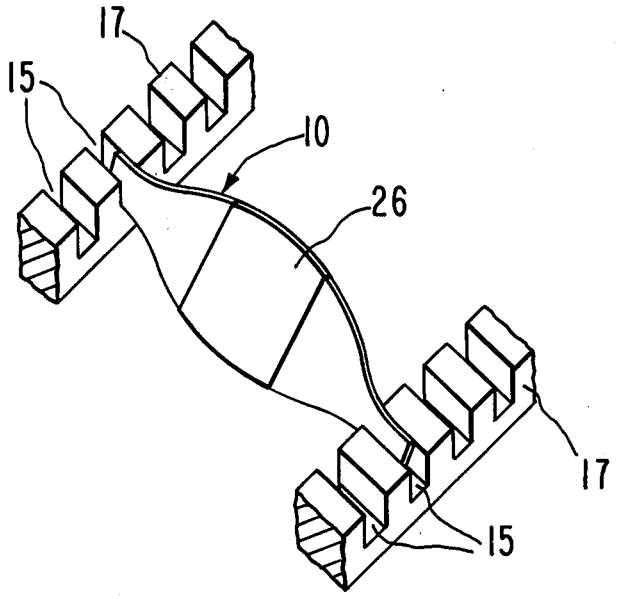
FIG. 12 is a perspective view of a louver in a support having slots parallel to the plane of the louver to eliminate the need for twisting the ends of the louver.
Figure 13:
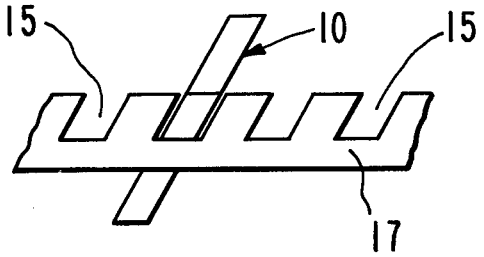
FIG. 13 is a side elevational view of the assembly of FIG. 12.

The method of fastening the clad layer can include any one of a number of different techniques including crimping, welding, brazing, folding into a locked position or by adhesive bonding. Individual louvers can then be attached to edge holding devices by similar mechanical techniques, including molding of plastic or ceramic materials around the extensions 18 and 20 of each device 10. Inlaying of the material can also be used. Individual louvers formed with conductive layers can be assembled in edge holding devices in any desired fashion including tight side-by-side spacing. This vastly improves current density per unit length of this assembly. For instance, FIGS. 12 and 13 show a louver 10 whose ends are in the same plane as the louver itself, i.e., the ends are not twisted. The ends drop into slots 15 of mounting members 17, the slots being parallel to the plane of the louver.

Figure 2:
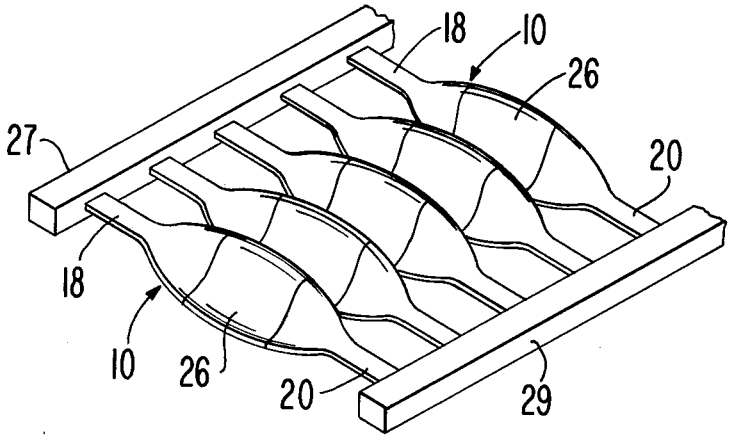
FIG. 2 is a fragmentary view of a group of louvered devices arranged in an assembly for use as an electrical connector.

Louvers can be used individually in assemblies of different configurations. One such assembly is shown in FIG. 2, wherein a plurality of louver devices 10 with clad layers 26 are arranged side-by-side with each other and have the ends of their extensions 18 and 20 secured to respective bars 27 and 29 in any suitable manner. The thickness of each bar is selected so that the side margins of clad layers 26 of devices 10 can make electrical contact with buss bars or plates 31 and 33 (FIG. 3) on opposed sides of the assembly. The plates are electrically conductive and are held in fixed, spaced positions by mechanical means (not shown). In such positions, they bear against the curved side portions of clad layers 26 as shown in FIG. 1*b* and louver devices 10 are slightly sprung so that they bias their respective layers 26 into firm, positive electrical contact with adjacent surfaces of plates 31 and 33. Also, bars 27 and 29 limit the amount of flexing which louvered devices 10 can be subjected to since the bars serve as spacers to prevent movement of plates 31 and 33 beyond a certain minimum distance.

Figure 3:
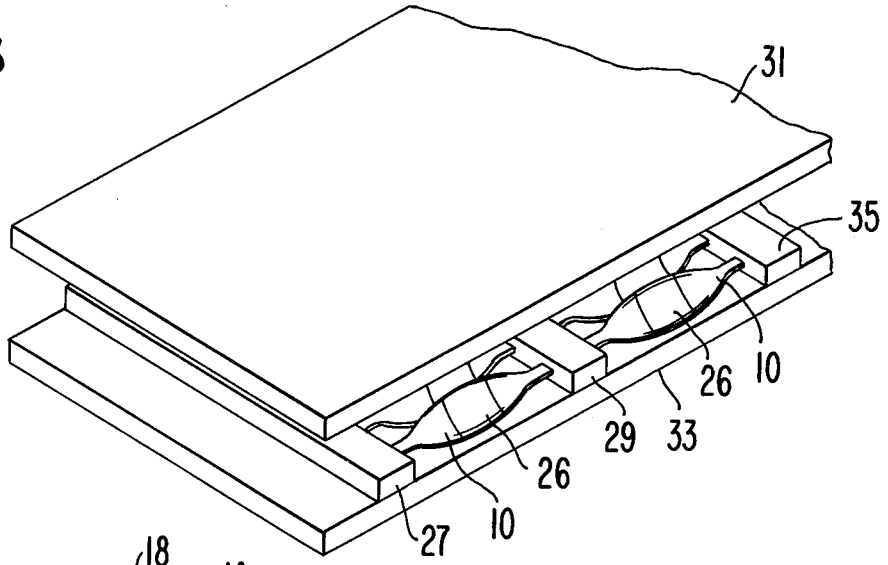
FIG. 3 is a fragmentary, perspective view of the assembly of FIG. 2 disposed between a pair of flat, electrically conducting plates defining a buss bar connector.

FIG. 3 also shows how a group of assemblies of the type shown in FIG. 2 can be combined to form a large bank of clad louvered devices. For instance, additional bar or bars 35 are provided so that additional louvered devices 10 can be coupled to and extend between bars 29 and 35.

FIG. 1*a* shows louvered device 10 provided with a clad layer 26 provided with fingers 37 formed by slits extending from the side margins of layer 26 toward the central region thereof. Fingers 37 can flex independently of each other so that they can be automatically adjustable for any surface irregularities on buss bars 31 and 33. The number of slits and their lengths are selected for particular design requirements.

Figure 4:
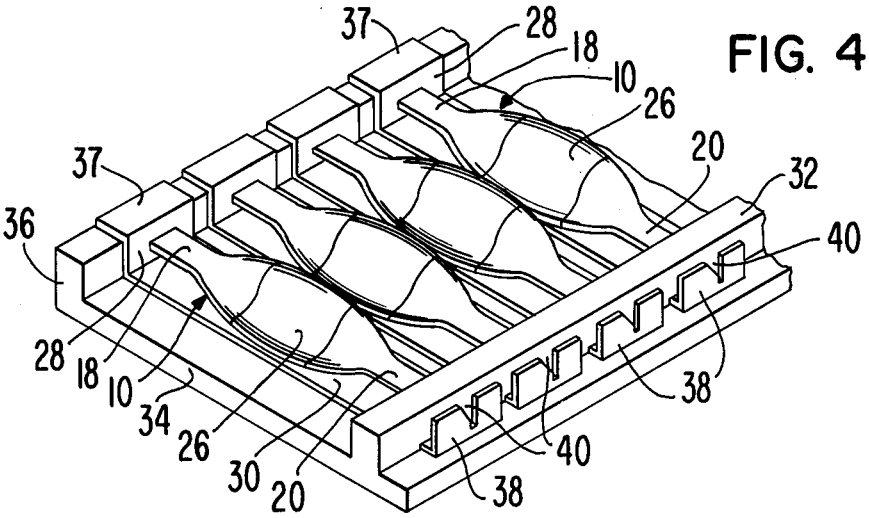
FIG. 4 is a view similar to FIG. 2 except that each louver acts individually and separately as a connector circuit.

Another assembly of louvered devices 10 is shown in FIG. 4, wherein the devices are arranged generally parallel with each other and have the ends of their extensions 18 and 20 secured in place in any suitable manner so that the clad layers 26 of devices 10 make electrical contact with respective electrically conducting strips 30. For instance, each extension 18 can be brazed, welded or otherwise secured to an end segment 28 of strip 30, while the opposite extension 20 can be embedded or otherwise bonded to a rail 32 integral with a panel or board 34 on which strips 30 are mounted. A second rail 36 of panel 34 abuts segments 28 and the latter can have a lateral projection 37 abutting one face of rail 36 and secured thereto such as by screws, adhesive or other fastening means. The opposite end of each strip 30 is provided with another segment 38 provided with a sharp V-groove 40 therein for special purposes, such as electrically connecting each strip and thereby its corresponding device 10 with a special type of connecting member.

Figure 6:
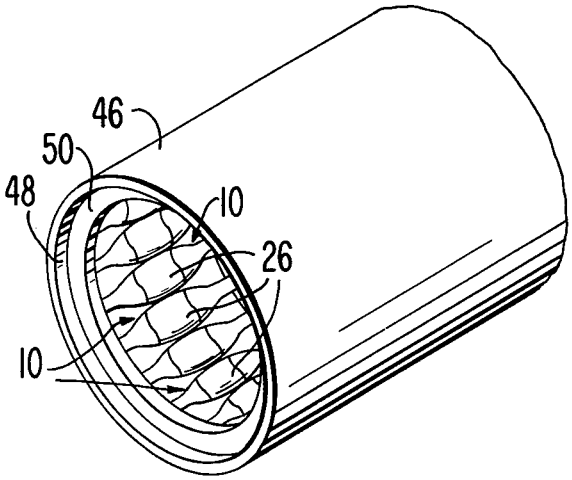
FIG. 6 is a perspective view of a tubular connector showing another embodiment of a group of louvered devices arranged within a cylindrical member.
Figure 5:
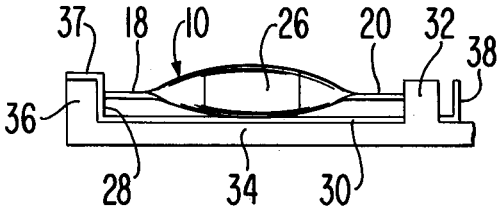
FIG. 5 is a side elevational view of the assembly of FIG. 4.

A plurality of louver devices 10 can be carried in a cylindrical tube or housing as shown in FIG. 6 and thereby can be used in plug-in socket applications. In the specific application shown in FIG. 6, an electrically conductive sleeve 46 has an open end 48 for receiving a cylindrical assembly of louver devices 10 which span the distance between a pair of rings 50, only one of which is shown in FIG. 6. Means (not shown) can be, if desired, added to the assembly to provide plug-gripping holding teeth to allow a plug to be inserted into the open end of connector 46 but, once in contact with the holding teeth, cannot be easily removed.

As shown in FIG. 6, each device 10 is clad with an electrically conducting material layer 26 as described above with respect to FIG. 1. When a plug is inserted into the open end 48, the plug will cause louver devices 10 to compress in a manner such that they will be biased both against the inner surface of sleeve 46 and against the plug, whereby the clad layers 26 will bridge the distance therebetween to provide an electrically conducting path therefor.

This same principle can be utilized where louvers are in a radial pattern layout as in a washer shape. In such case, the louvers will surround a central axis and will be provided with concentric inner and outer rings between which the louver devices will span.

The foregoing establishes that the present invention is essentially based on the ability to clad or overlay an electrically conductive material on a spring member. The spring member can be either metal, plastic, ceramic or similar materials. The mechanical and thermal properties of the spring member are separate and distinct from the characteristics of the conductive material overlay. In a preferred design, the mechanical spring would be a high grade spring material, such as stainless steel, formed into a single louver shape. The overlay or clad layer could be of electrical grade copper sheet or film which is plated or unplated and attached to the central part of the spring member.

End holding members, such as bars 27 and 29 for extensions 18 and 20 of the various louver devices 10, hold the individual louver devices in desired patterns and the holding members also function as a deflection limiting means for each louver device. By selecting the thickness of the edge holding device, the amount of louver deflection can be accurately controlled.

Louver devices connected to non-conductive edge holding devices can function as individual circuit connectors or as multiple contacts for higher currents greater than that usable with an individual louver device. For example, one louver device may have a maximum current-carrying capacity of 10 amperes. It may transfer this specific current as an independent contact device. If ten such louver devices are formed in an assembly, such as the assembly of FIG. 2, they are able to work together to transfer a much larger current since the current is distributed through louver devices themselves. Thus, if one louver device 10 can handle 10 amperes, ten such devices can handle 100 amperes as in FIG. 3.

Clad louver devices as described above with respect to this invention can be fabricated not only from various combinations of materials to combine the best properties for a particular application, but can be of various sizes in both length and width. Wide louvers employing highly conductive metals offer a distinct advantage in numerous applications with wide mechanical tolerances required. For example, if the conductive overlay is silver, the conductive capacity would be at its optimum for most applications. This means that the louvers are as conductive as the material they connect. Louvers can then be as large as necessary without sacrificing the electrical or thermal properties as would be necessary if hardened berylium copper were used as an electromechanical device rather than the aforesaid material combination. The width of these leaf louvers can be used to allow for much larger mechanical tolerance between mating surfaces in all applications. This is only possible with this unique design. Thus, if 200 amp buss bars were to be connected with a multiplicity of louvers, as in FIG. 3, twenty louvers capable of handling 10 amps each would be used.

Another use for clad louver devices would be to incorporate the above louver device assembly inside a standard size piece of copper or conductive metal pipe and allowing for the louver device to contact the inner surface of this pipe. For connecting purposes, another smaller size but standard electrically conductive rod could be inserted into the first pipe, thereby creating an inexpensive pin and socket assembly, eliminating machining and other costs.

Another use of the louver device of this invention is in applications where the devices are connected in parallel with a flexible plastic material incorporated at the end of a line of louver devices. A solid sheet of conductive material is also used. The strip can then be rolled up, forming a cylindrical shape with the outside surface being the conductive sheet. This feature would create its own socket for a pin insertion as required. For the combination of clad louver devices connected to edge holding strips, mechanical teeth can be built into the edge holding portion to create a holding device for the connecting device. The resulting unit would be of the type shown in FIG. 6.

Figure 7:
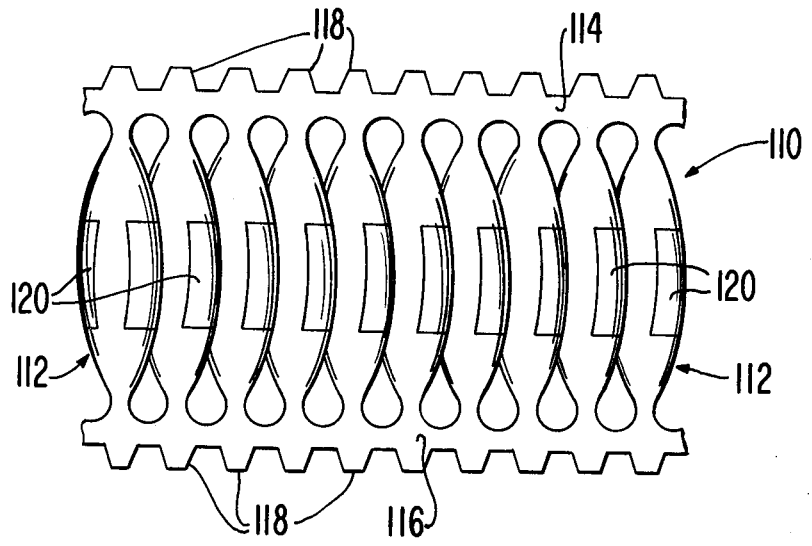
FIG. 7 is a side elevational view of a louver connector having louvers integral with a pair of side strips, with the louvers having a layer of electrically conductive material of greater conductivity than the base material.

Other embodiments of the present invention include assembly 110 (FIGS. 7, 10 and 11), wherein a plurality of louver devices 112 which are integral at their opposed ends to respective strips 114 and 116 are side-by-side relative to each other. The strips are generally coplanar with each other when assembly 110 is in a flattened condition, yet the strips can be made of material of flexible nature so that the assembly can be shaped in any suitable form, such as in a cylindrical form. Each of strips 114 and 116 has spaced edge-wise teeth 118 which can be bent to provide spacers or standoff means as desired or needed.

Figure 10:
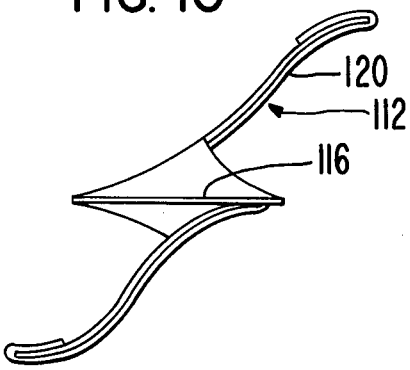
FIG. 10 is a view similar to FIG. 9 but showing second ways in which the layer material is applied to each louver.
Figure 11:
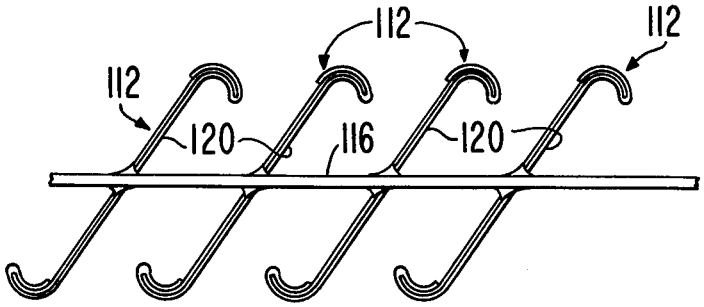
FIG. 11 is a view similar to FIG. 9 but illustrating a louver connector with a non-conductive edge holder.

Each of louver devices 112 is provided with a clad layer 120 of electrically conducting material, layers 120 being at the central portions of devices 112 and being applied thereto in any one of the ways described above with respect to louvered devices 112. Moreover, each louver device 112 has a pair of opposed, convex, curved outer margins as shown in FIGS. 10 and 11, and it is clear that layers 120 are complemental to such curved outer margins, yet the central portions of the layers are contiguous with the central portions of louvered devices 112.

The material forming louver devices 112 and strips 114 and 116 can be electrically non-conducting or electrically conducting, as desired or necessary. It can be molded or stamped and the clad layers can be applied thereto generally after formation of the louvers. FIG. 10 shows an enlarged end elevational view of one of devices 112 showing one form of the outer margins of the device. FIG. 11 shows a group of such devices with another form of outer margins on louvers 112.

Figure 8:
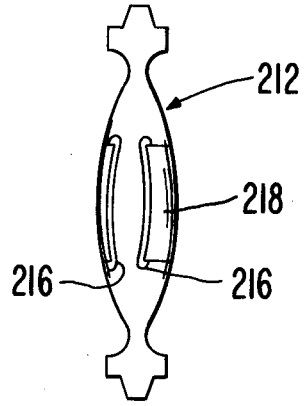
FIG. 8 is another embodiment of the single louver device showing an electrically conducting material clad thereto.
Figure 9:
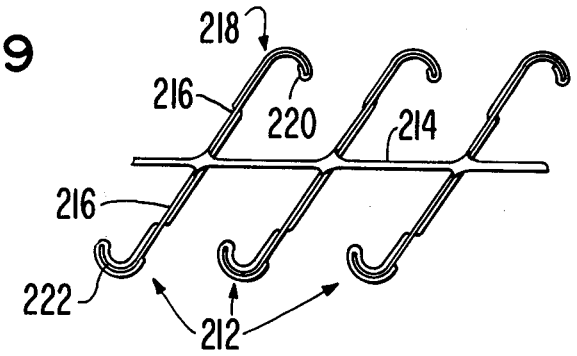
FIG. 9 is a side elevational view of an assembly of louvers showing the layer material passing through slots to allow the material to pass from one face of each louver to the opposite face thereof.

FIGS. 8 and 9 show still another embodiment of a louvered device, denoted by the numeral 212. A plurality of such devices is shown in FIG. 9 and is of the form in which a pair of opposed, generally coplanar strips 214 are used in the manner shown in FIG. 7 to join devices 212 in an integral fashion.

Each device 212 has a pair of spaced slits 216 therein for receiving a clad layer 218. Thus, the layer commences at one curved outer margin of the device, then upwardly and over, and down along one face of the device, then through the first slit 216, then along the opposite face of the device to the next slit 216, then through the slit and along the first-mentioned face and about the opposite outer margin 222. In this way, layer 218 is properly supported along both faces of the device and is in the proper orientation at the outer margins 220 and 222 to provide an electrical current path between members in engagement with the layer at or adjacent to such outer margins 220 and 222. The embodiment of the single louver device 212 of FIG. 8 allows it to be used to make assemblies of the type shown in FIG. 2.

I claim:

1. An electrical connector comprising: an elongated device having a pair of opposed ends and a louver extending between said ends, the louver having a pair of spaced side margins; and a layer of electrically conducting material on said louver independently thereof for forming an electrical current-carrying path between said side margins, said layer having a number of flexible fingers adjacent to each side margin, respectively, of said louver.

2. An electrical connector for a pair of spaced electrical conductors comprising: an elongated, louvered device having a pair of opposed ends and a louver coupled to and extending between said ends, said louver having a pair of opposed side margins, said ends adapted to be secured to a support for mounting the device between a pair of electrical conductors with said louver at an angle relative thereto so that said side margins are adjacent to said conductors, and a layer of electrically conducting material on said louver and extending from one side margin to the other side margin, said layer having spaced side edge portions for engaging said conductors when said device is in said operative position, whereby said layer defines an electrical current-carrying path between said conductors, said layer having a number of flexible fingers adjacent to each side margin, respectively, of said louver.

* * * * *